United States Patent [19]

Lindeboom

[11] 4,334,804

[45] Jun. 15, 1982

[54] FRICTION ROCK STABILIZER AND METHOD OF INSTALLING SAME IN AN EARTH STRUCTURE

[75] Inventor: Herman Lindeboom, Ringoes, N.J.

[73] Assignee: Ingersoll-Rand Company, Woodcliff Lake, N.J.

[21] Appl. No.: 138,168

[22] Filed: Apr. 7, 1980

[51] Int. Cl.[3] ..... E21D 20/00; E21D 21/00

[52] U.S. Cl. ..... 405/259; 405/253

[58] Field of Search ..... 405/258, 253, 259; 175/56

[56] References Cited

U.S. PATENT DOCUMENTS 4,012,913 3/1977 Scott ..... 405/259

4,026,116 5/1977 Purcupile et al. ..... 405/259

FOREIGN PATENT DOCUMENTS 46-32813 9/1971 Japan ..... 405/253

141792 2/1961 U.S.S.R. ..... 175/56

*Primary Examiner*—Price C. Faw, Jr.

*Assistant Examiner*—Nancy J. Pistel

*Attorney, Agent, or Firm*—David W. Tibbott; Bernard J. Murphy

[57] ABSTRACT

The stabilizer comprises a generally tubular, metal body, the leading end of which has been hardened to rock-cutting strength in order that the stabilizer, according to the method of invention, can be impacted with a high frequency, low-blow actuator to cause the stabilizer to bore its own hole in the earth structure, this to eliminate a pre-boring, stabilizer installation step.

9 Claims, 3 Drawing Figures

FRICTION ROCK STABILIZER AND METHOD OF INSTALLING SAME IN AN EARTH STRUCTURE

This invention pertains to friction rock stabilizers, and methods of installing the same in an earth structure, and in particular to a stabilizer especially prepared to bore and penetrate the earth structure, thereby to form its own borehole, and a method for simultaneously forming the borehole and installing the stabilizer in the earth structure.

Friction rock stabilizers known in the prior art typically require that boreholes first be drilled to accommodate the thereafter installed stabilizers. Accordingly, the use of the friction rock stabilizers has required a two-step process. In the first step, a drill must be brought into place to bore into the rock, following which the drill has to be moved out of the way in order that, next, an inserter and stabilizer can be put into place.

It is an object of this invention to eliminate one of the steps of the friction rock stabilizer, prior art, insertion method by teaching an improved, simplified method of installation, and also a novel stabilizer especially adapted for use with the method.

It is another object of this invention to set forth a method of installing a friction rock stabilizer in an earth structure for stabilizing the structure, comprising the steps of forming a borehole in an earth structure for installation therein of a friction rock stabilizer; and installing a friction rock stabilizer in the formed borehole; wherein said forming and installing steps are performed simultaneously.

Finally, it is an object of this invention to set forth a friction rock stabilizer, comprising an elongate, substantially tubular, metal body; said body having an installation-leading end, and an installation-trailing end; wherein at least said leading end has been hardened to rock-cutting strength.

Further objects of this invention, as well as the novel features thereof, will become more apparent by reference to the following description, taken in conjunction with accompanying figures in which.

Figure 1:
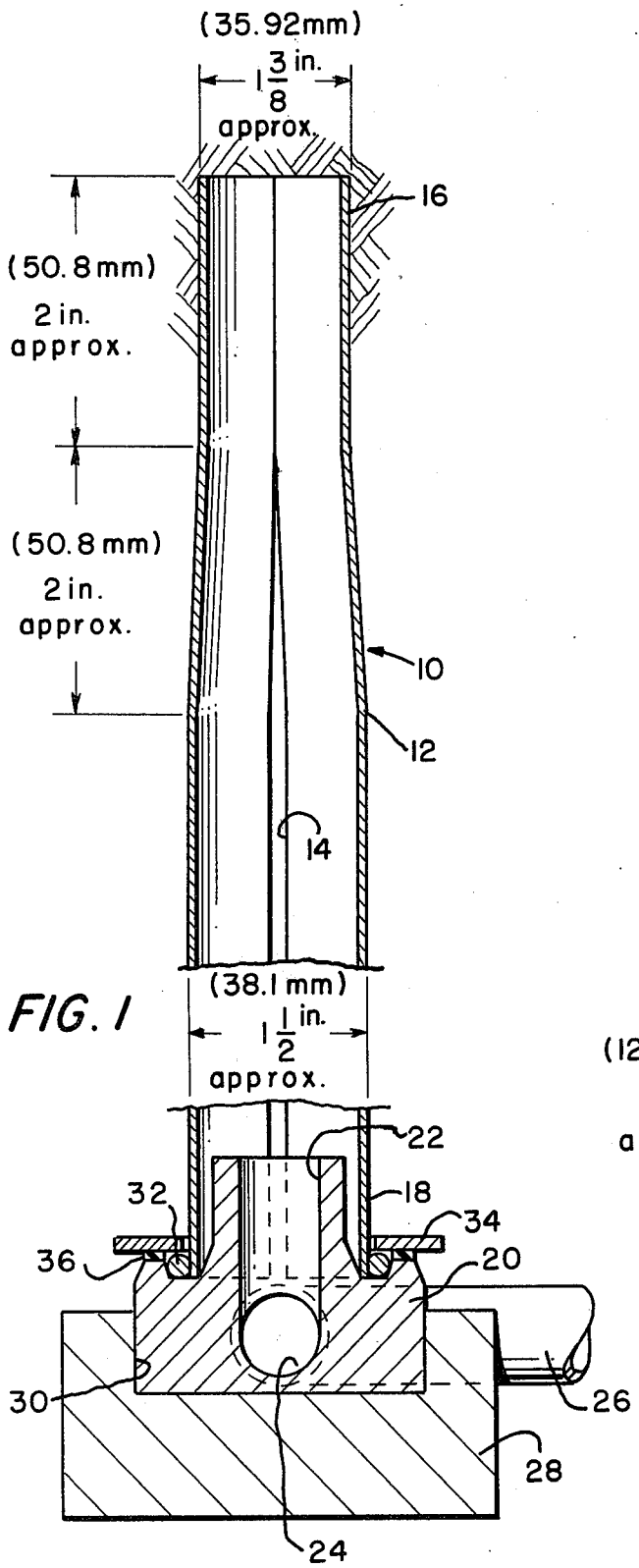
FIG. 1 is a discontinuous, longitudinal, cross-sectional view of an embodiment of the inventive friction rock stabilizer, engaged with a chuck and a percussive actuator, the stabilizer being shown making an entry into an earth structure.

As shown in the figures, a friction rock stabilizer 10, comprising a substantially tubular, metal body 12, has an axially extending slit 14 which is open throughout the length thereof, excepting the leading end 16. The leading end 16 of the stabilizer is necked down, so that the slit 14 is closed, thereat, defining a circumferentially continuous form. The leading end 16, for approximately two inches (50.80 mm) of length (from the terminal end), is straight-sided, and of slightly smaller diameter than the principal length of the body 12. Immediately therebelow, through a same approximately two-inch transitional length, the body 12 is smoothly and gradually bowed out to meet the larger, principal-length body diameter.

A leading edge 16*a* of end 16 of the stabilizer, according to the invention, has been hardened to enable it to cut and penetrate rock.

Figure 2:
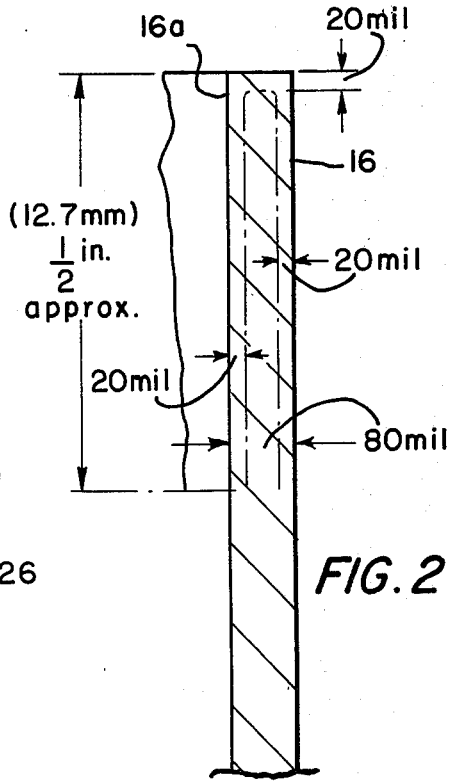
FIG. 2 is an enlarged detail of only the leading end of the stabilizer of FIG. 1 showing the extent of hardening therein.

One-half inch (12.70 mm.) approximately, of edge 16*a* has been carburized and heat-treated to give it a hardness taken from a range of approximately 40 to 63 Rockwell C. The wall thickness of the body 12 is approximately 80-mil, and the aforesaid hardening has been formed in the leading edge 16*a* to a depth of approximately 20-mil into the inside diameter surface, the outside diameter surface, and into the annular surface at the foremost end of the body, as shown in FIG. 2.

The trailing end 18 of the stabilizer 10 is engaged with a chuck 20 through which to receive percussive forces. The chuck 20 is hollow, having a central passageway 22 formed therein through which rock chips and fragments are withdrawn, through a port 24 by means of a vacuum hose 26.

Figure 3:
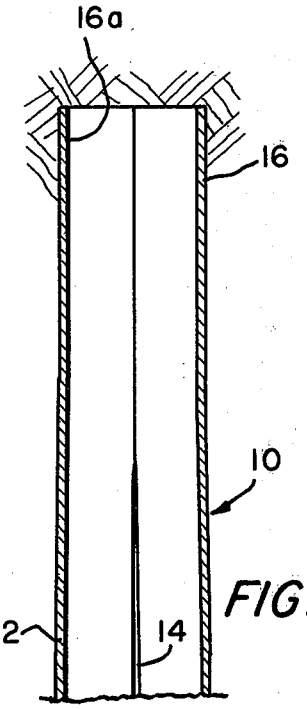
FIG. 3 is a partial longitudinal, cross-sectional view of the stabilizer embodiment of FIG. 1, showing partial installation in an earth-structure borehole.

A percussive actuator 28, having a recess 30, receives the chuck 20 therein and delivers a low-blow, high frequency percussion to the chuck and stabilizer. The leading end of the stabilizer, in turn, cuts its own entry into the rock. The outside dimension of the leading end 16, in this embodiment, is approximately $1\frac{3}{8}$ inch (35.92 mm). The remainder of the body 12 has a free outside diameter of approximately $1\frac{1}{2}$ inch (38.1 mm.). The leading end will cut a borehole conforming to its diameter and, as the stabilizer 10 proceeds into the forming borehole, it is circumferentially compressed, so much that the slit 14 is almost or substantially closed (as shown in FIG. 3).

The stabilizer 10 has an end-reinforcing ring 32 which is welded to the body 12. It provides a bearing surface for the conventional roof plate 34, besides reinforcing or strengthening the trailing end 18. In order that the percussion will not cause undue noise, through oscillation of the plate 34 on the ring 32 and chuck 20, an annular, elastomeric cushion 36 is fixed on the chuck, between the plate 34 and the chuck itself. The cushion 36 has sufficient height to insure that, until final bottoming of the stabilizer 10 in the borehole, the plate will avoid contacting the ring 32.

While I have described my invention in connection with a specific embodiment thereof, it is to be clearly understood that this is done only by way of example, and not as a limitation to the scope of my invention as set forth in the objects thereof and in the appended claims.

I claim:

1. A method of installing a friction rock stabilizer in an earth structure for stabilizing the structure, comprising the steps of:

forming a borehole in an earth structure for installation therein of a friction rock stabilizer; and installing a friction rock stabilizer in the formed borehole; wherein said forming and installing steps are performed simultaneously; and said installing step comprises compressing the stabilizer while installing the latter in the borehole.

2. A method, according to claim 1, wherein:

said forming step comprises forming a borehole in immediate, contacting adjacency to the installation-leading end of the friction rock stabilizer, and deepening the borehole while installing the stabilizer.

3. A method, according to claim 2, further including the step of:

hardening at least the installation-leading end of the stabilizer; and wherein said forming step comprises addressing said stabilizer end, which has been hardened as aforesaid, to the earth structure, and forcing said end into the structure to form the borehole thereby.

4. A method, according to claim 3, wherein:

said forcing step comprises percussively forcing said stabilizer into the structure.

5. A method, according to claim 4, wherein:

said forcing step comprises percussively impacting the installation-trailing end of the stabilizer with a high frequency impactor.

6. A method of installing a friction rock stabilizer in an earth structure for stabilizing the structure, comprising the steps of:

forming a borehole in an earth structure for installation therein of a friction rock stabilizer; and installing a friction rock stabilizer in the formed borehole; wherein said forming and installing steps are performed simultaneously; and said forming step comprises forming a borehole which has a greatest transverse dimension which is less than the greatest transverse dimension of the stabilizer being installed therein.

7. A friction rock stabilizer, comprising:

an elongate, substantially tubular, metal body;

said body having an installation-leading end, and an installation-trailing end; wherein at least said leading end has been hardened to rock-cutting strength;

said body has a substantially uniform cross-section, and a given, greatest transverse dimension, along a substantial length thereof; and said leading end has a greatest transverse dimension which is less than said given dimension.

8. A friction rock stabilizer, according to claim 7, wherein:

said leading end has been hardened to a Rockwell hardness taken from a range of approximately 40 to 63 Rockwell C.

9. A friction rock stabilizer, according to claim 7, wherein:

said body is circumferentially discontinuous along said substantial length thereof; and said leading end is circumferentially continuous.

* * * * *